US006840075B2

(12) United States Patent
Neri et al.

(10) Patent No.: US 6,840,075 B2
(45) Date of Patent: Jan. 11, 2005

(54) QUICK RELEASE/EJECT DRIVE ASSEMBLY

(75) Inventors: Frank J Neri, Saugus, CA (US); Gordon R. Bussard, Burbank, CA (US); John A. Duran, Glendora, CA (US)

(73) Assignee: AVK Industrial Products, division of SPS Technologies, Inc., Valencia, CA (US)

( * ) Notice: Subject to any disclaimer, the term of this patent is extended or adjusted under 35 U.S.C. 154(b) by 203 days.

(21) Appl. No.: 10/325,189

(22) Filed: Dec. 20, 2002

(65) Prior Publication Data

US 2004/0118176 A1 Jun. 24, 2004

(51) Int. Cl.[7] ..... B21J 15/12
(52) U.S. Cl. ..... 72/114; 72/391.4; 72/391.8
(58) Field of Search ..... 72/114, 391.2, 72/391.4, 391.8; 29/243.518, 243.526; 279/22, 30, 905

(56) References Cited

U.S. PATENT DOCUMENTS

| | | | | | |
|---|---|---|---|---|---|
| 666,509 | A | | 1/1901 | Furbish | |
| 1,468,732 | A | | 9/1923 | Bradbury | |
| 2,913,263 | A | | 11/1959 | Zajac | |
| 3,260,541 | A | | 7/1966 | Sadler et al. | |
| 3,406,556 | A | * | 10/1968 | Walton | 72/122 |
| 4,121,444 | A | | 10/1978 | Duran | |
| 4,574,612 | A | * | 3/1986 | Tanikawa | 72/391.8 |
| 4,577,875 | A | | 3/1986 | Miyakawa | |
| 4,588,335 | A | | 5/1986 | Pearson, Jr. | |
| 4,692,073 | A | | 9/1987 | Martindell | |
| 4,701,083 | A | | 10/1987 | Deutschenbaur et al. | |
| 5,013,194 | A | | 5/1991 | Wienhold | |
| 5,398,946 | A | | 3/1995 | Quiring | |
| 5,573,255 | A | | 11/1996 | Salpaka | |
| 5,605,070 | A | * | 2/1997 | Wille | 72/391.4 |
| 6,018,978 | A | * | 2/2000 | Aniento | 72/391.4 |
| 6,053,675 | A | | 4/2000 | Holland et al. | |
| 6,270,085 | B1 | | 8/2001 | Chen et al. | |
| 6,325,393 | B1 | | 12/2001 | Chen et al. | |
| 6,449,822 | B1 | * | 9/2002 | Gilbert et al. | 29/243.521 |
| 6,457,916 | B2 | | 10/2002 | Wienhold | |

* cited by examiner

*Primary Examiner*—Ed Tolan
(74) *Attorney, Agent, or Firm*—Fulwider Patton Lee & Utecht, LLP

(57) ABSTRACT

A quick release drive assembly intercouples a reversible hand held motor and a drive screw for mounting blind fasteners in place. A replaceable adaption assembly includes the drive screw, the nosepiece of the unit and a drive adaptor for supplying torque from the motor to the drive screw. An outer housing is coupled to the nosepiece by three ball bearings which extend into a peripheral groove in the nosepiece, and which are held in place by a locking zone of reduced inner diameter in a quick release sleeve. The quick release sleeve has an adjacent release zone of increased inner diameter, into which the ball bearings may shift. A locking spring biases the quick release sleeve to its locked position. An eject spring is operative when the quick release sleeve is shifted to its released position, to eject the adaption assembly. A spring limiting sleeve limits the travel of the ejection spring and also holds the quick release sleeve in its released position until a new nosepiece assembly is inserted into the housing. A locking pin secured to the housing extends through a slot in the quick release sleeve to positively lock the sleeve in its locked position, except for one angular orientation of the quick release sleeve.

21 Claims, 5 Drawing Sheets

QUICK RELEASE/EJECT DRIVE ASSEMBLY

FIELD OF THE INVENTION

This invention relates to a quick release/ejection mechanism for an actuator drive assembly.

BACKGROUND OF THE INVENTION

Blind threaded fasteners and tools for installing them are known, and they involve fasteners which are intended for use on metal or plastic sheets or panels, particularly where one side of the sheet or panel is not readily accessible. The fasteners often involve an enlarged head, an internally threaded outer end, and an intermediate, thin-walled hollow tube interconnecting the head and the threaded outer portion. The fastener is mounted into a hole in the panel. A drive screw extends through the thin walled hollow tube and the drive screw is rotated to pull the threaded portion of the fastener toward the panel, with the result being that the thin walled tubular part of the fastener collapses, extending laterally outward beyond the hole in engagement with the panel, and the fastener is securely held in the panel by the head on the accessible side of the panel, and by the enlarged collapsed portion of the fastener on the inaccessible side of the panel.

Tools for installing blind fasteners of the type described above involve a drive screw as noted above, and a drive system which senses increased resistance to rotation of the drive screw after the fastener collapses. The direction of rotation of the drive screw is then reversed to withdraw the drive screw from the fastener.

Many different sizes of blind fasteners, or blind anchor nuts, are employed, and it is of course necessary to use different size drive screws to accommodate the different size blind fasteners. In addition, with the size of the drive screw changing, a corresponding new thread adaption kit is required; and this adaption kit may include a nose piece assembly, a bearing set and a drive adaptor to fit the drive screw. It is desirable to have a firm and positive drive when the blind fasteners are being secured in place, and it is also desirable to be able to quickly and conveniently change the thread adaption kit, when different size blind fasteners are to be secured in place. Up to the present time these desirable features have not been realized to the desired extent.

SUMMARY OF THE INVENTION

Accordingly, it is an object of the invention to provide a firm and positive drive for actuators; and also to provide a convenient arrangement for releasing and ejecting the thread adaption parts when shifting to a different size fastener.

In accordance with one specific illustrative embodiment of the invention, a quick release/eject drive assembly includes a handheld rotary power source, a drive screw, a thread adaption kit having a nosepiece, and a quick release-eject assembly mounted to the rotary power source at one end of the release-eject assembly and to the nosepiece at the other end thereof. A lock-release sleeve is normally spring biased to a front-to-rear locked position by a locking spring, and a separate ejection spring applies ejection force to the nosepiece. The nosepiece has a peripheral groove into which three small locking balls or ball bearings are seated and held in place by a reduced diameter area of an overlying lock-release sleeve. When the lock-release sleeve is manually shifted against the locking spring force the locking balls shift into an enlarged diameter groove in the lock-release; and the ejection spring pushes the nosepiece forward thereby permitting changing of the thread adaption kit. In addition, a locking pin mates with a control slot in the lock-release sleeve so that the sleeve may be rotated angularly to fully block any release action for safety during fastener securing operations. This control slot extends angularly around the lock-release sleeve for a limited distance, and at one end of the slot, it also extends longitudinally, or axially, to facilitate or enable the axial release action of the lock-release sleeve as the locking pin is aligned with the axially extending portion of the slot.

In accordance with a broader aspect, a quick release assembly including a housing is connected between (1) a power input point and (2) a drive screw, forming part of an adaption assembly. The adaption assembly includes a nosepiece which is secured to the housing by a releasable detent mechanism. A quick release sleeve has a release position and a locking position relative to the detent mechanism, and is biased toward the locking position. An eject spring applies an ejection force to the adaption assembly which is operative to eject the adaption assembly when the quick release sleeve is shifted to the release position.

Other features may include any or all of the following:

(a) knurling on the outer surface of the quick release sleeve.

(b) the use of an adaptor drive linkage as part of the adaption assembly to couple torque to the drive screw.

(c) The inclusion of the nose piece, the drive screw and the adaptor drive linkage as replaceable parts when different size blind fasteners are to be mounted.

(d) The provision of an outer housing sleeve, with the locking pin extending from the outer housing sleeve through the slot in the quick release sleeve, into the main housing.

Other objects, features and advantages of the invention will become apparent from a consideration of the following detailed description and from the accompany drawings.

DETAILED DESCRIPTION OF THE PREFERRED EMBODIMENTS

While the specification describes particular embodiments of the present invention, those of ordinary skill can devise variations of the present invention without departing from the inventive concept.

Figure 1:
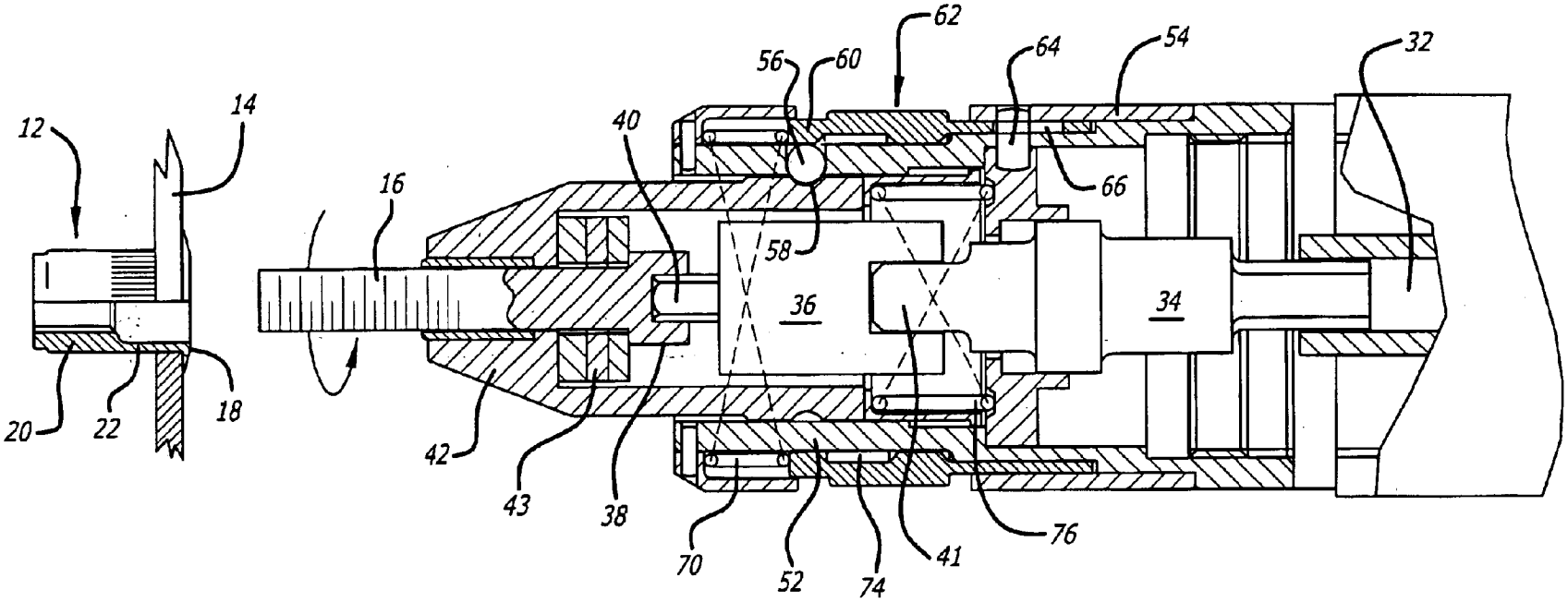
FIG. 1 is a diagramatic showing of a blind fastener mounted in a panel, and a driver illustrating the principles of the invention, for securing the fastener in place.

Referring more particularly to the drawings, FIG. 1 shows a blind fastener 12 which has been placed in a hole through a panel 14, with the drive screw 16 shown in position to secure the fastener 12 in place.

We will now consider FIGS. 2 and 3, with further description of FIG. 1 being deferred to a later point in this specification.

Figure 2:
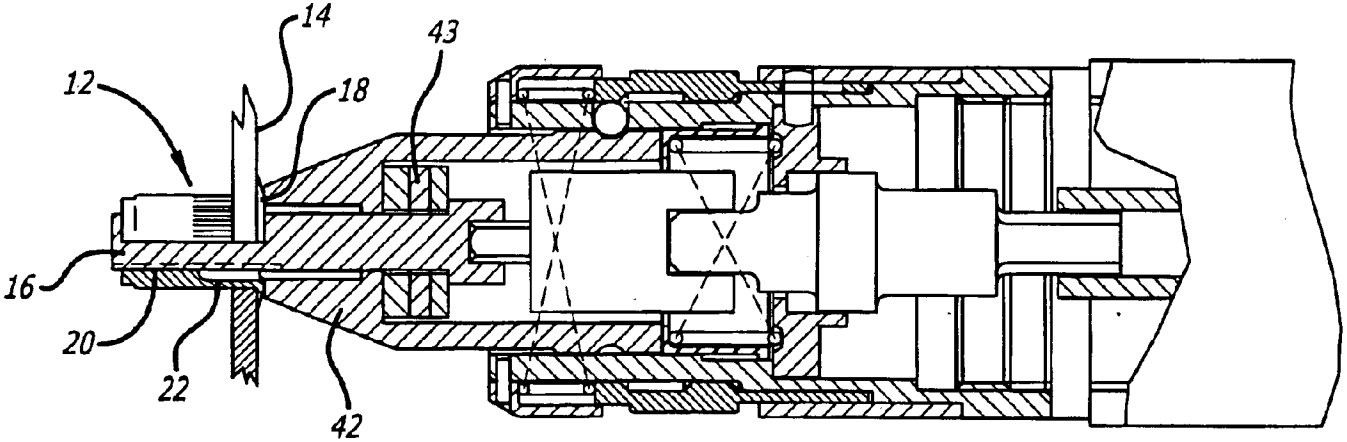
FIG. 2 shows the next step for securing the blind fastener of FIG. 1 into place, with the drive screw in threaded engagement with the fastener.
Figure 3:
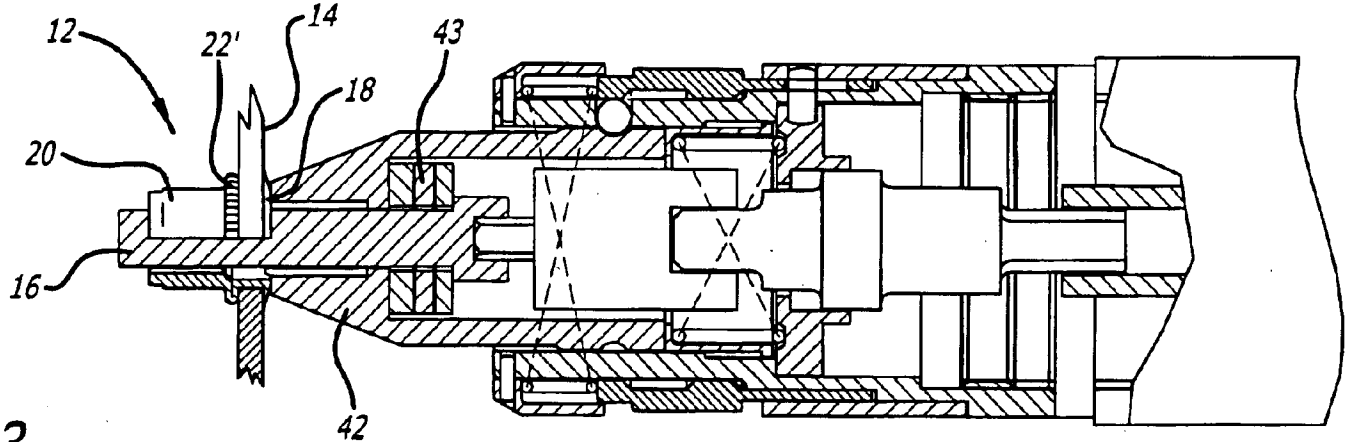
FIG. 3 shows the third step in securing the fastener in place.

With regard to the fastener 12 of FIGS. 1 and 2, it includes the head 18, an outer threaded portion 20, and a collapsible thin walled portion 22. In FIG. 2, the drive screw 16 is shown threaded into the outer threaded area 20 of the blind fastener 12.

Further rotation of the drive screw 16 pulls the outer end 20 of the fastener 12 inward, collapsing the thin walled portion 22' against the inner surface of the panel 14 so that the fastener 12 is secured in place. The increased resistance to further rotation of drive screw 16 is sensed, and the direction of rotation of drive screw 16 is then reversed to separate the drive screw 16 from fastener 12.

The blind fastener 12 is then secured into the panel 14 and is available for receiving threaded bolts to attach other panels or parts to the panel 14.

Figure 4:
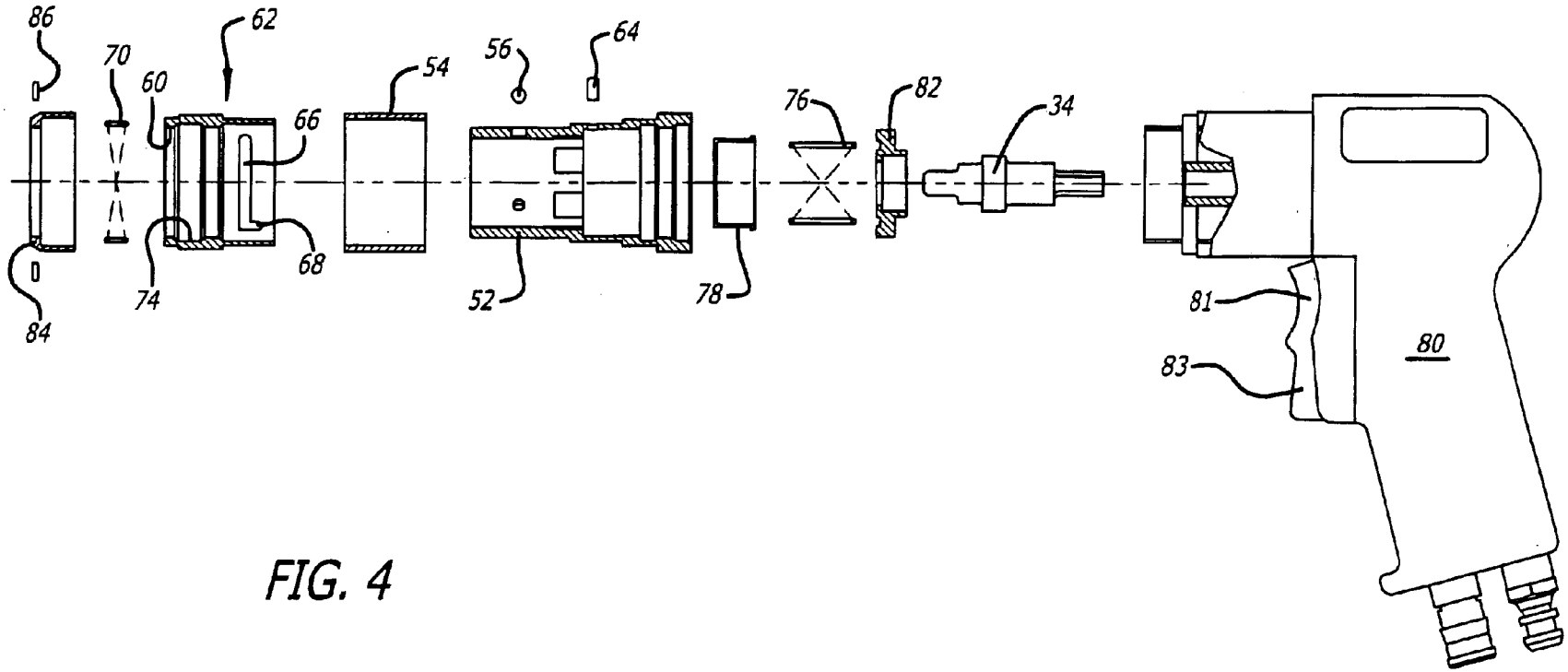
FIGS. 4 and 5 are exploded views of a blind fastener driver, illustrating the principles of the invention, with special emphasis on arrangements for changing the drive screw to accommodate different sizes of blind fasteners.
Figure 5:
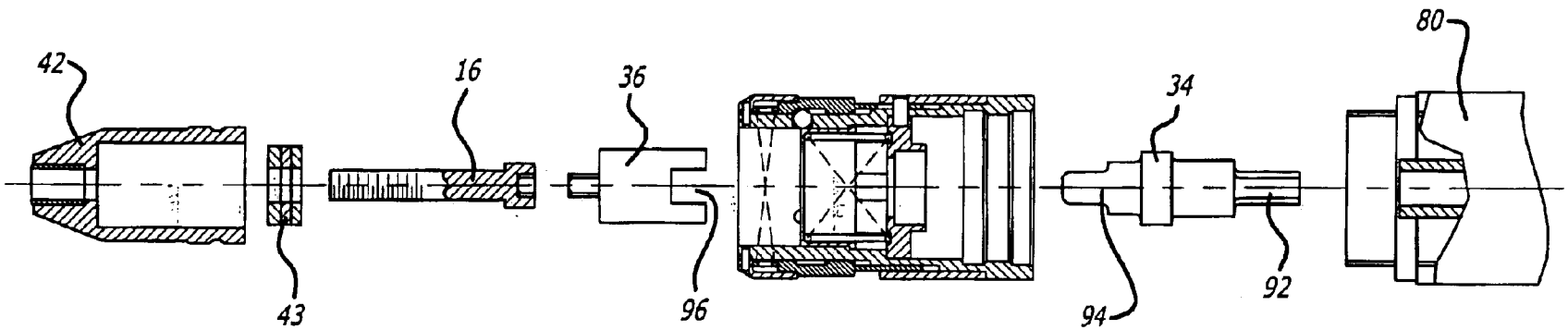

Now that the general mode of securing blind fasteners in place has been reviewed, attention is directed to the driver and particularly to the arrangements for quickly changing the drive screw arrangements to secure different size blind fasteners in place, as shown in FIGS. 1, 4 and 5. Incidentally, with regard to the exploded views of FIGS. 4 and 5, FIG. 4 shows the parts fully exploded, while in FIG. 5 the quick release subassembly is shown assembled, and in the released configuration.

In accordance with the present invention, the driver includes quick release/eject arrangements by which the nosepiece 42, drive screw 16 and associated adaption arrangements are normally locked in place, but which may be quickly released and ejected in order to insert new drive arrangements for different size blind fasteners.

More specifically, referring back to FIG. 1 of the drawings, the driver shown in FIG. 1 of the drawings include a driven hollow shaft 32 with a square drive opening, a drive member 34, and an adaptor 36, coupling to the drive screw 16. Incidentally, the drive screw 16 may have an Allen head hex recess at the head 38 thereof. The adaptor 36 has a mating hex extension 40 interfitting with the hex head 38, and a slot at its inner end to receive the flat end 41 of the drive member 34.

The nosepiece 42 guides the drive screw 16, and, as shown in FIG. 2, serves to bear against the head 18 on the panel 14, as the blind fastener is collapsed. Accordingly, with different size blind fasteners, the nosepiece 42, the drive screw 16 and adaptor 36 must be changed, along with associated bearings 43.

Figure 7:
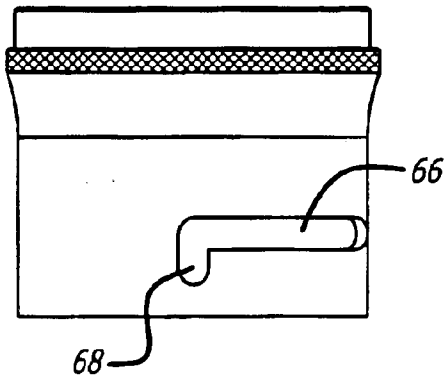
FIGS. 6, 7 and 8 are part drawings of the lock/release sleeve employed in the assemblies shown in other figures of the drawings.
Figure 6:
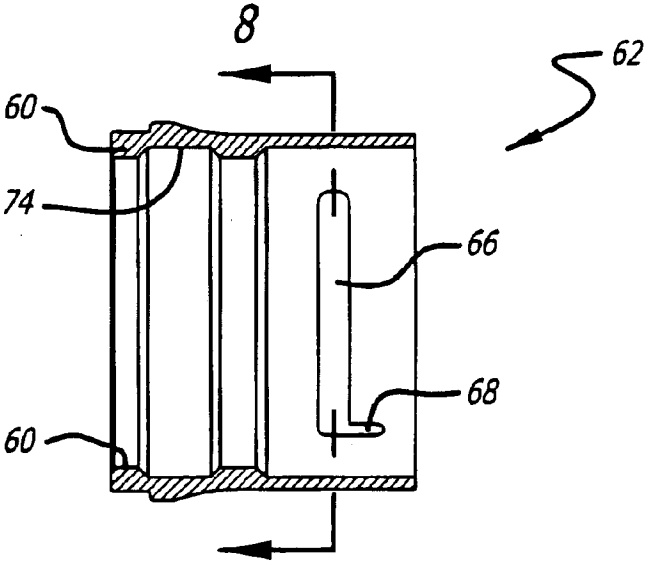
Figure 8:
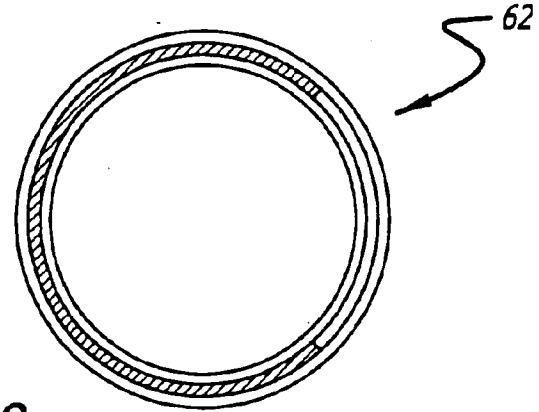

Consideration will now be given to the quick release/eject mode of operation with particular reference to FIGS. 1, 4 and 5. Initially, it may be noted that the nosepiece 42 is held into the housing 52 and the outer housing sleeve 54 by three ball bearings 56 which are held down into recesses or a peripheral groove 58 in nosepiece 42, by the front, reduced inner diameter zone 60 of quick release sleeve 62. It may also be noted that the pin 64 is located to extend through a slot 66 (see FIGS. 6 and 7) in quick release sleeve 62.

The quick release sleeve 62 may be rotated through 90°, with the slot 66 and pin 64 holding the sleeve 62 against axial movement. However, when sleeve 62 is rotated so that pin 64 is in the axially extending zone 68 of slot 68 (see FIGS. 6 and 7), the sleeve may be moved axially. In this regard, note that a relatively weak spring 70 biases quick release sleeve 62 to the locked position, even when the pin 64 is aligned with slot portion 68. Under these conditions, the quick release sleeve may be moved forward (to the left in FIG. 1) so that the three ball bearings 56 may shift outward into the increased inner diameter zone 74 of quick release sleeve 62.

The larger and more forceful spring 76 then gives the adaption assembly including nosepiece 42 a vigorous outward ejection push through autolock sleeve 78. The drive screw 16, the nosepiece 42, the bearings 43 and the adaptor 36 can then be changed to match a different size blind fastener 12.

Incidentally, it may be noted from FIG. 5 that, as the nosepiece 42 is ejected, the autolock sleeve 78 remains in its forward position, holding the ball bearings 56 in their outward position. Then the new nosepiece assembly may be directly inserted, pushing the autolock sleeve 78 back. The smaller spring 70 then pushes quick release sleeve 62 back, permitting ball bearings 56 to lock the new nosepiece in place. This simple and quick capability for replacing tooling is a useful advantage of this design.

For completeness, it may be noted that additional parts included in FIGS. 1, 4 and 5 include the following: reversible pneumatic air motor 80, inner housing sleeve 82, cover 84, and pins 86 which secure the cover 84 to the front of housing 52.

Figure 9:
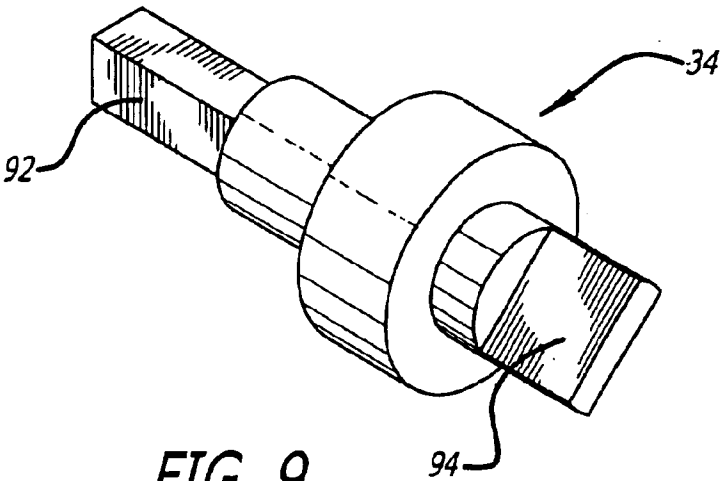
FIG. 9 is a perspective view of a coupling member included in the drive chain of the driver shown in other figures of the drawings.

FIG. 9 is a perspective or isometric view of the coupling member 34 shown in FIGS. 1 and 5. The coupling member 34 has a square cross-section end 92 for mating with the output of motor 80. The other end 94 of coupling member 34 has a blade configuration for interfitting with the slot 96 of the adaptor 36. Accordingly, the drive chain includes motor 80, coupling member 34, adaptor 36, and finally, the drive screw 16.

Regarding the motor 80 as shown in FIG. 4 of the drawings, a suitable pneumatic motor is made by The Aro Corporation, and is available from the assignee of the present invention, AVK Industrial Products, 25323 Rye Canyon Road, Valencia, Calif. 91355-1271. In practice, the upper portion 81 of the dual trigger is actuated to operate the motor in one direction, until the motor stalls or slows, indicating that the blind fastener has collapsed. The lower portion 83 of the trigger is then actuated to reverse the motor rotation, and remove the drive screw from the fastener.

In conclusion, it is to be understood that the foregoing detailed description and accompanying drawings relate to one preferred embodiment of the invention. Various changes and modifications may be made without departing from the spirit and scope of the invention. Thus, by way of example and not of limitation, the drive screw 16 and the adaptor 36 could be combined as a single part: the pin 64 could extend outward from the housing 52, and the outer housing could be eliminated; instead of the ball bearings 56 and coil spring 70 a resilient detent of another type could be provided to restrain the quick release sleeve 62 against premature release; and other mechanical arrangements performing substantially the same functions could be substituted for specific parts included in the assembly. Accordingly the present invention is not limited to the specific embodiment shown in the drawings and described in detail hereinabove.

We claim:

1. A quick release drive assembly for mounting blind fasteners, comprising:

a drive screw;

a housing;

a nosepiece for guiding said drive screw, said nosepiece being held into said housing by a plurality of ball bearings extending into recess arrangements in said nosepiece;

a quick release sleeve mounted on said housing, said sleeve having a locked position in which a zone of reduced inner diameter engages said ball bearings, and a release position in which a zone of enlarged inner diameter permits outward movement of said ball bearings;

a locking spring for biasing said quick release sleeve to the locked position;

an ejection spring for ejecting said nosepiece out of said housing; and said quick release sleeve being manually movable from said locked position to said release position against the force of said locking spring, whereby the ejection spring ejects the nosepiece from the housing.

2. An assembly as defined in claim 1 wherein a mechanical coupling mounted within said housing is provided to rotate said drive screw.

3. An assembly as defined in claim 1 further comprising a drive motor having an output drive member; and an adaptor for applying torque from said drive member to said drive screw.

4. An assembly as defined in claim 1 wherein said quick release sleeve has a slot extending peripherally through a side wall thereof at a predetermined axial location, said slot also extending longitudinally along said sleeve at one end of the slot, and a pin secured to said housing extending through said slot.

5. An assembly as defined in claim 1 wherein positive locking arrangements are provided for blocking movement of said quick release sleeve to the release position.

6. An assembly as defined in claim 1 wherein means are provided for limiting the travel of said ejection spring.

7. An assembly as defined in claim 1 wherein said quick release sleeve has an outer knurled surface.

8. An assembly as defined in claim 1 wherein an autolock sleeve is provided for limiting the travel of said ejection spring, said autolock sleeve also holding said ball bearings in their release position until a nosepiece is inserted into the housing, engaging said autolock sleeve and compressing the ejection spring as the nosepiece is locked into the housing.

9. A quick release drive assembly comprising:

a drive screw;

a housing;

a nosepiece for guiding said drive screw, said nosepiece being held into said housing by detent arrangements;

a quick release sleeve mounted on said housing, said sleeve having a locking position and a release position relative to said detent arrangements;

a resilient member for biasing said quick release sleeve to the locked position;

an ejection spring for ejecting said nosepiece out of said housing; and said quick release sleeve being manually movable from said locked position to said release position against the force of said resilient member whereby the ejection spring ejects the nosepiece from the housing.

10. An assembly as defined in claim 9 wherein a mechanical coupling mounted within said housing is provided to rotate said drive screw.

11. An assembly as defined in claim 9 further comprising a drive motor having an output drive member; and an adaptor for applying torque from said drive member to said drive screw.

12. An assembly as defined in claim 9 wherein said quick release sleeve has a slot extending peripherally through a side wall thereof at a predetermined axial location, said slot also extending longitudinally along said sleeve at one end of the slot, and a pin secured to said housing extending through said slot.

13. An assembly as defined in claim 9 wherein positive locking arrangements are provided for blocking movement of said quick release sleeve to the release position.

14. An assembly as defined in claim 9 wherein means are provided for limiting the travel of said ejection spring and for holding said locking sleeve in the released position.

15. An assembly as defined in claim 9 further comprising a reversible drive motor, and mechanical coupling arrangements for rotating said drive screw from said drive motor.

16. A quick release drive assembly for mounting blind fasteners, comprising:

a drive screw;

a housing;

a nosepiece for guiding said drive screw, said nosepiece being held into said housing by a plurality of ball bearings extending into recess arrangements in said nosepiece;

a quick release sleeve mounted on said housing, said sleeve having a locked position in which a zone of reduced inner diameter engages said ball bearings, and a release position in which a zone of enlarged inner diameter permits outward movement of said ball bearings;

resilient means for biasing said quick release sleeve to the locked position;

means for applying force to eject said nosepiece out of said housing; and said quick release sleeve being manually movable from said locked position to said release position against the force of said resilient biasing means whereby the nosepiece is ejected from the housing.

17. An assembly as defined in claim 16 wherein said quick release sleeve has a slot extending peripherally through a side wall thereof at a predetermined axial location, said slot also extending longitudinally along said sleeve at one location, and a pin secured to said housing extending through said slot.

18. An assembly as defined in claim 16 wherein positive locking arrangements are provided for blocking movement of said quick release sleeve to the release position.

19. An assembly as defined in claim 16 wherein means are provided for limiting the travel of said means for applying force to eject said nosepiece.

20. An assembly as defined in claim 16 further comprising a reversible drive motor, and mechanical coupling arrangements for rotating said drive screw from said drive motor.

21. An assembly as defined in claim 16 further comprising a hand held motor, a mechanical coupling extending from said motor into said housing, and an adaptor in driving engagement with said mechanical coupling at one end and in driving engagement with the head of said drive screw at the other end thereof.

* * * * *

UNITED STATES PATENT AND TRADEMARK OFFICE

CERTIFICATE OF CORRECTION

PATENT NO. : 6,840,075 B2 
DATED : January 11, 2005
INVENTOR(S) : Frank J. Neri, Gordon R. Bussard and John A. Duran It is certified that error appears in the above-identified patent and that said Letters Patent is hereby corrected as shown below:

Title page,
Item [75], Inventors, delete "Frank J Neri" and insert -- Frank J. Neri -- (period after J).

Signed and Sealed this

Seventeenth Day of May, 2005

JON W. DUDAS
*Director of the United States Patent and Trademark Office*